United States Patent [19]

Hardman

[11] Patent Number: 4,651,777

[45] Date of Patent: Mar. 24, 1987

[54] ELECTRONIC CONTROL APPARATUS

[76] Inventor: Raymond H. Hardman, 8724 N. 121 East Ave., Owasso, Okla. 74055

[21] Appl. No.: 758,650

[22] PCT Filed: Oct. 3, 1983

[86] PCT No.: PCT/US83/01557

§ 371 Date: Oct. 3, 1983

§ 102(e) Date: Oct. 3, 1983

[87] PCT Pub. No.: WO85/01560

PCT Pub. Date: Apr. 11, 1985

[51] Int. Cl.[4] ..... F16K 31/02; E03D 5/10; G01S 15/00

[52] U.S. Cl. ..... 137/487.5; 251/129.04; 251/129.01; 367/198; 4/623; 4/DIG. 3

[58] Field of Search ..... 251/129, 129.04; 4/DIG. 3, 305, 620, 623; 340/825.19, 825.65; 367/197, 198; 137/487.5

[56] References Cited

U.S. PATENT DOCUMENTS

| | | | |
|---|---|---|---|
| 3,836,959 | 9/1974 | Dao et al. | 340/825.65 |
| 4,141,091 | 2/1979 | Pulvari | 4/DIG. 3 |
| 4,309,781 | 1/1982 | Lissau | 4/305 X |
| 4,349,885 | 9/1982 | Thompson | 137/487.5 X |
| 4,402,095 | 9/1983 | Pepper | 4/305 X |

FOREIGN PATENT DOCUMENTS

| | | | |
|---|---|---|---|
| 504185 | 4/1939 | United Kingdom | 4/DIG. 3 |

*Primary Examiner*—Arnold Rosenthal
*Attorney, Agent, or Firm*—Robert E. Massa

[57] ABSTRACT

A water supply system control (10) includes a microphonic circuit (34) which responds to audio signals and converts those signals into electrical signals which may be timed as chosen in order to control a solenoid-driven water valve assembly (14).

9 Claims, 9 Drawing Figures

ELECTRONIC CONTROL APPARATUS

DESCRIPTION

1. Technical Field

My invention relates to an electronic control apparatus, and, more particularly, to electrical control of water supply systems, and, still more particularly, to electrical control apparatus for water supply systems which include electrically controllable outlet valves and electronic circuit means to operate the outlet valves.

Still more particularly, my invention relates to electronic circuit means of a water supply system in which the circuit means receives an outside signal and transduces the signal to a proper signal within the system to direct the outlet valve to the proper state, either on or off.

Electronic or electrical components are incorporated within water systems for one or both of two basic purposes: for conserving water, or for the convenience of the user of the water system.

For the purpose of conserving water, a control device for a water supply apparatus usually assures the owner of the water supply apparatus, whether it is in a public area or in a residence, that water will be allowed to flow to the apparatus only when the water is necessary, and above all, that the supply will be cut off when the user has left the immediate area of the apparatus. As shown in some of the prior art cited below, there have been various controls employed for conserving water. Some of these controls involve the interruption of a light beam, some rely upon a change of inductance, or capacitance, caused by the approach of the user, to operate a main supply valve.

In those apparatus which are designed for the convenience of the user, again, the electrical or electronic control may be based upon a change in inductance, or capacitance, or upon a physical touch by the user other than a touch with his hands.

2. Background Art

Some of the typical electrical and electronic controls which might be employed for various purposes and in different types of water supply systems were found in the prior art among the following patents:

U.S. Pat. No. 2,015,962, E. Praetorius et al
U.S. Pat. No. 2,085,198, Lindsay
British No. 504,185, Sheard
U.S. Pat. No. 3,551,919, Forbes
U.S. Pat. No. 3,639,920, Griffin et al
U.S. Pat. No. 3,724,001, Ichimori et al
U.S. Pat. No. 3,731,025, Filliung
U.S. Pat. No. 4,032,822, Un
U.S. Pat. No. 4,141,091, Pulvari
U.S. Pat. No. 4,196,423, Carver et al

DISCLOSURE OF INVENTION

Therefore, the primary object of my invention is to provide a control device for a water supply system which is inexpensive, easy to manufacture, and easy to use.

Another object of my invention is to provide an efficient control device for a water supply system.

Still another object of my invention is to provide a control device for a water supply system which will conserve water.

Still another object of my invention is to provide an electrical control system for a water supply system such that the water supply may be turned on or off by the user without physical contact with the water supply system.

Still another object of my invention is to provide a water supply control device which will respond to an acoustic signal to control the on and off flow of water.

In summary, I have designed an electrical control device for a water supply system which will enable the user to control the flow of water as he deems necessary for his benefit, which includes for his comfort and convenience as well as for his saving of money by saving energy and water. The saving of energy is accomplished by controlling the flow of heated water.

I have also designed my control system so that the system may be easily and quickly installed in essentially any type of water system and that the system may provide an easy and simple means of controlling the flow of water by the user, whether he has a physical incapacity or whether he desires to control the water supply system because of any hygienic or sanitary consideration.

The prior art cited above illustrates some of the control systems designed to operate under various conditions and for various purposes. Some of these electrical controls operate in response to a mechanical impulse, some operate by interruption of a light beam, and others operate in response to the approach of a person, by either a change in inductance or change in capacitance.

As may be readily seen, a single type of electrical control system may be employed for different purposes. For example, an acoustic switch may be used for a burglar alarm system or for operation of a garage door; or, a proximity-actuated switch may be used for an industrial chemical process or for residential plumbing devices.

Therefore, although I am describing a preferred embodiment of my invention as comprising an electrical control apparatus for a water supply system, I anticipate employing modifications of the components and circuits shown in order that the apparatus will respond to particular signals to control other types of valves or other types of relays or switches.

For instance, I would expand the control circuits to respond to a multiplicity of signals so that each condition of the entire system would be controlled by its own particular signal between the two extreme states of on and off. Thus, each state could be made to respond to its own specific signal, as by a particular audible signal such as a particular number of sound occurrences or a particular quality of sound.

The preferred embodiments of my invention which I am describing herein comprise a manner of controlling a water supply system by means of electrical controls which respond to audible signals in order to actuate water supply valves.

I am particularly describing my invention as being used in conjunction with a shower in a residential bathroom. The primary purpose of my design is to allow the user to conserve water and energy (energy, because of heated water) at his convenience.

These important advantages are obtained by the application of very few, and simple, low-cost components.

My apparatus comprises only two major components: a solenoid valve which is mounted in the water supply line, and a control unit which is connected to the solenoid valve.

In a typical residential shower installation, where there is an existing shower head, that shower head is removed and the solenoid valve component is attached to the water supply line and the shower head is attached to the solenoid valve, thus permitting the solenoid valve to act as a shutoff control for the shower. Then the control unit portion of the apparatus is connected to the solenoid valve by a small length of flexible electrical cable and the control unit is mounted on the wall, preferably near the shower head.

A low voltage battery contained in the control unit powers the solenoid valve, and a chosen sound signal generated by the user is picked up by a microphone within the control unit to actuate the control unit.

Then, as I have designed one form of my invention, the user places the on-off switch of the control unit in the "on" position. (If he wishes, he may maintain this switch in the "on" position because the unit is not electrically actuated until water pressure is "sensed" at the valve assembly). The user then turns on the water faucets. At this time, water pressure is "sensed" at the valve assembly by the control unit and water is allowed to flow.

The user usually performs two adjustment steps in the operation of his shower unit. He adjusts the hot and cold water faucets for the most suitable water temperature. Then he may adjust a sensitivity control in the control unit to cause the control to respond, alternately on or off at a chosen noise level. He might need to adjust the sensitivity control only infrequently, or even only once, at the time the system is first used after being installed. The control unit will then respond to the change in sound level which is determined by the movement of the user from beneath the shower spray for one condition and alternately to a further noise change for a second condition. Thus, in one manner of use, with the water supply on, the user may step out from beneath the shower, and the change in sound level will cause the control unit to turn the water supply off. Then, when the user wants the water to flow again, he makes a suitable sound to which the control unit will respond. To turn the water on, the user may rap on the wall of the shower at a proper distance from the control unit, or he may utter a sharp verbal sound, as by speaking the word "On!". He is able to alternate the shower condition as he pleases. Then, when he is finished with his shower, he may turn the water faucets off in the usual manner.

BEST MODE FOR CARRYING OUT THE INVENTION

Figure 1:
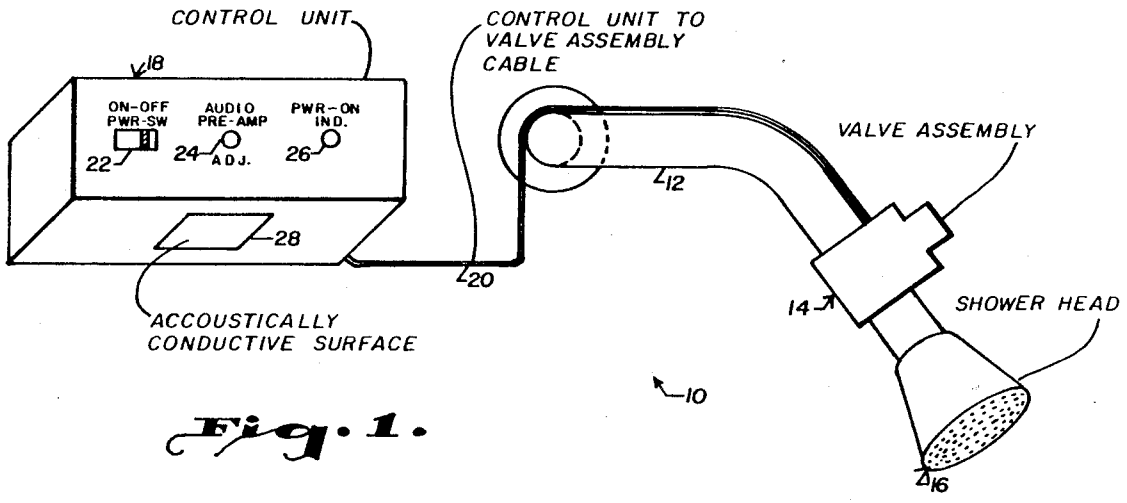
FIG. 1 is a side elevational view of a water supply system control according to my invention.

FIG. 1 describes a typical water supply system control 10, generally, according to my invention as it would be adaptable for a residential shower, comprising a water supply line 12, to which the user of the system has attached a control valve assembly 14, generally, in the manner I have described above, and to which assembly the user has attached a shower head 16, generally. My system includes a control unit 18, generally, which contains the operating circuitry of my system and which, as I suggested above, should be mounted on the wall of the bathroom at a suitable location. Then, an electric cable 20 connects the control unit 18 to the control valve assembly 14.

In FIG. 1 I have shown several outer components of the control unit 18 which either operate or identify components of the electrical system which are shown schematically in the subsequent drawings. For instance, a power switch 22 is the main electrical actuator for the system; a pre-amp adjustment knob 24 provides means for manual adjustment of a portion of the circuit; power-on indicator window 26 provides means for an on-off signal light to be seen; and an acoustically conductive surface 28 provides means for transmitting sound from the exterior of the control unit to an acoustic pick-up component of the circuit. Preferably, this surface 28 is a means of conducting sound associated with a microphone or similar component of a circuit as described hereinafter.

In FIGS. 2 thru 9 I have outlined certain circuit portions by dotted lines in order to make it easily understandable how the various circuit portions operate and the function served by each such portion. The operation of these circuit portions will be readily understood by one who is skilled in the art. Also, in the figures, I have assigned similar numbers and descriptions to like components in the various modifications wherever possible for the sake of brevity and clarity.

I also want to emphasize that I anticipate using the most suitbale arrangement of an integrated circuit wherever possible to achieve the purposes I have outlined for my invention.

Figure 2:
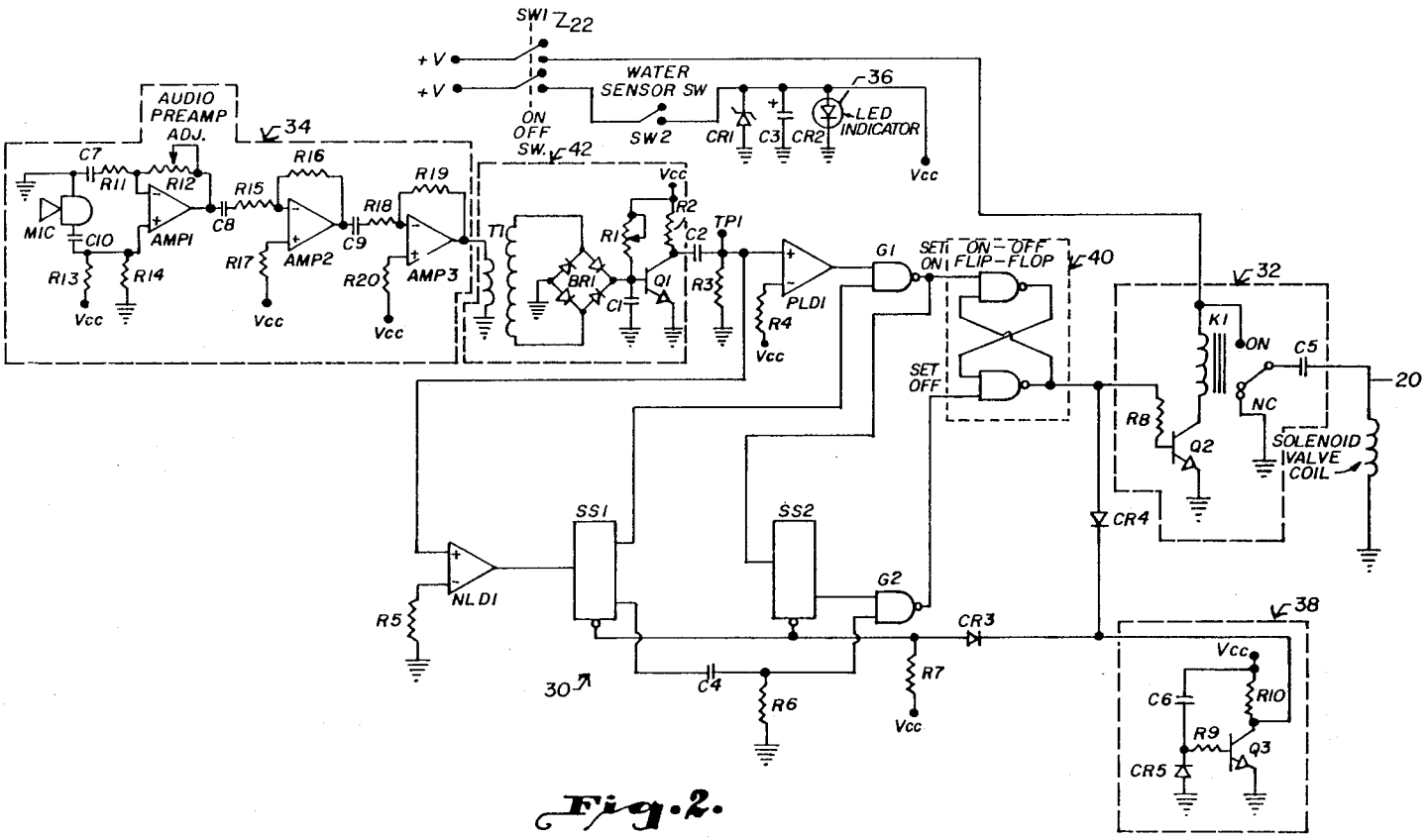
FIG. 2 is a schematic diagram of one form of my invention exemplifying one circuit embodiment.

In FIG. 2 I have described a preferred embodiment of one form of circuitry for my apparatus. In this embodiment I have shown my water supply control 10, generally, to include one form of electrical control system 30, generally.

As I stated above, I have designed my system to include only two major components, a valve in the water supply line and an electrical control unit to respond to an audible signal and thereby control the operation of the valve. FIG. 2 discloses a solenoid valve coil drive circuit 32, generally, within the dotted lines, to operate a typical solenoid valve within control valve 14, and, a microphone and audio amplification state circuit 34, generally, which receives and responds to an audible signal and directs solenoid valve coil drive circuit 32 to react in the proper manner and place valve 14 in the correct position, that is, neither "on" or "off".

In addition to the two fundamental functions of my invention, that is, the reception of an audio signal and the control of a water supply valve, I have disclosed in the figures a number of circuit and control embodiments.

For instance, I prefer to describe the system of FIG. 2 as my MODE I operation. I prefer to describe the systems shown in FIGS. 4, 8, and 9 as my MODE II operation. I then describe the system shown in FIG. 3 as my DUAL MODE, which means that I have designed that system to operate as either a MODE I or MODE II system, whichever the user chooses.

I describe the embodiment of FIG. 2 as my MODE I operation because, when the system is ready to operate, one word, or rap on the wall, will cause the water to flow, and a sudden, sustained, increase in noise level will cause the water to be turned off, as I have described above.

I define the embodiments of my MODE II operation as adaptable to respond to one or more sharp sound signals. That is, the circuitry is designed so that two signals are required to turn the valve "on" and one signal is required to turn the valve "off".

I shall describe the system from the initial action of the user and how each unit functions, and, where an element is well-known to someone skilled in the art, I shall not go into excessive detail.

Power is supplied to the unit by a conventional source, as a battery, which I show as +V. The user turns on the system by actuating power switch 22. Then, after the user turns on the main water valve, the water is detected by water sensor switch SW2 which then closes and completes the circuit, allowing power to be supplied to the circuit. The completion of the circuit is indicated by activation of LED indicator 36. A zener diode CR1 and a capacitor C3 are added to help control the voltage.

Upon this initial circuit activation, power-up initializer circuit 38, generally, has its output at ground level which is applied to both timing circuits SS1 and SS2 for them to be reset. SS1 and SS2 are conventional single-shot timing elements. At the same time, this ground level sets an on-off flip-flop 40, generally, to the "on" state. This ground level insures that when the shower is first turned on, the control circuit will be switched to the proper state. The ground level of this initializer circuit will occur upon initial activation and will continue for a given time, approximately 3 seconds.

From the time the system is turned on, the microphone and audio amplification stage 34 is sensing all sound, and as a result, all sounds, or noise signals, will be amplified by the audio pre-amp AMP1 and the following amplification circuits, AMP2 and AMP3. the operation of this amplification unit 34 is readily understood by one skilled in the art. The last stage of the amplification unit, AMP3, applies this signal to the input primary of transformer T1. The output of transformer T1, from its secondary, is applied to diode bridge unit BR1 which rectifies the noise signal into a DC voltage and applies it to an input of transistor Q1. This DC voltage level changes with the audio signal level. The louder the noise, the more positive this voltage becomes.

This voltage level change changes the biasing, and, in turn, causes the collector current of transistor Q1 to change, which results in a voltage change at the output of Q1.

Transistor Q1 operates within the linear region which allows its output to vary linearly in accordance with the noise level. That is, as the noise level increases, the output becomes less positive, and vice versa, as the noise level decreases, the output becomes more positive.

By operating within this linear region and not in the cutoff and saturation region, the pre-amp adjuster should not have to be re-adjusted continually, as by re-setting for a new noise level threshold, to compensate for different operating noise levels appearing because one person uses a different water flow rate than another person.

It is only the DC voltage level change of Q1 output that is used by the following differentiating network.

As I have shown in the drawings, transformer T1, bridge unit BR1 and transistor Q1 are all part of what I refer to as noise rectification and filtering circuit 42, generally.

Capacitor C2 and resistor R3 form a differentiating network in which the output level and polarity are a function of the voltage level change and direction of change of transistor Q1.

When the user is showering, a relatively constant noise level exists, therefore, Q1's actual output voltage level, since it is not changing sufficiently, will not cause any voltage at the output of this differentiating network, which may be determined at test point TP1.

When the user wishes to discontinue the water flow, he moves out from under the shower. There is a drastic increase in the noise level caused by all of the water hitting the floor of the shower or tub directly. This increased noise level causes Q1 output voltage to become less positive, and this decrease in voltage causes a negative pulse at TP1. This negative pulse with regards to ground activates NLD1 (negative level detect 1) circuit which has a normally high output, +5 v., but now goes to ground for the duration of TP1's negative pulse. The result of the output of NLD1 going to ground triggers timing circuit SS1. Since at this time the increased noise level will exist for perhaps several seconds or more, SS1 will time out before a positive pulse occurs at TP1, which now means that gate G1, which sets the on-off flip-flop to the "on" state, will not be enabled.

At this time out point, the lower output (Q not output) of the SS1 timing circuit will go from ground to +5 v. This positive level change causes a positive voltage pulse at a second differentiating network output. This circuit is composed of capacitor C4 and resistor R6. The positive pulse is in turn applied to the bottom input of gate G2.

Since gate G1 was not enabled, SS2's timing circuit was not triggered, so the lower output of SS2, or upper input to gate G2 is positive, enabling gate G2 which sets the on-off flip flop to the "off" state. The output of flip-flop 40 at this time biases transistor Q2 which allows current to flow through relay coil K1, energizing it, causing the common contact of the relay K1 to make connection with the normally open contact, which is tied to the +v. supply. This positive voltage is felt through capacitor C5 to the top side of the solenoid valve coil until capacitor C5 charges up.

This voltage now causes current to flow in valve coil 32 in the direction to make the valve close and stop the water flow.

Capacitor C5 allows current to flow only for a given time, i.e., time for the valve to switch from one state to the other.

When it is desired that water flow be continued, the beginning of a relatively quick audio signal, (shorter in duration than the SS1 time out), will create a negative pulse again at TP1, which will set and start the time out of timing circuit SS1.

The top output of SS1 goes positive again until time out. This applies the positive voltage at the lower input to gate G1. Since this signal is shorter in duration than the time out of SS1, the decrease in noise level, (when the quick noise stops), causes the output of Q1 to become more positive, in turn causing a positive pulse to be produced at TP1. This this positive pulse is also applied at the top input to gate G1. Gate G1 is enabled since both of its inputs are now positive. The enabling of gate G1 causes the on-off flip-flop to be set to the "on" state again, causing transistor Q2 to be biased off, discontinuing the current flow through the coil of relay K1, de-energizing it. Thus, the common contact of the relay makes connection with the normally closed contact, causing the left side of the capacitor C5 to go to ground, which means that capacitor C5 is directly across the solenoid valve coil.

Since the capacitor C5 was previously charged, (left side positive, right side negative), the voltage charge on C5 will cause current to flow in the opposite direction in the valve coil which now makes the valve open.

Since going from the energized condition to the de-energized condition of relay K1 causes the valve to open, the valve is always forced open at the end of the shower, when the control unit is deactivated. This is also caused by the valve coil circuit arrangement. The valve will stay open up through the starting of the next shower.

The process of stepping out of the shower to stop the water flow, and subsequently making a quick audible sound to resume water flow may be repeated as many times as the user wishes.

A latching type solenoid valve is usually used because it has two stable states, open or closed, and the only time current is needed, is for only a very short time, during the time of switching from one state to the other. Thus, this slight current usage will provide a much longer life for the battery.

Although I have suggested a latching type solenoid valve in this embodiment, I am aware that there are other types of valves which could be used, such as a normally open or normally closed solenoid valve, a stepping valve, etc. In some of these cases, the valve drive circuit would be somewhat modified, and in the drawings I have shown some modified drive circuits.

Time circuit SS1 should be adapted to have approximately a 2 second time-out. Then, timing circuit SS2 should be adapted so that its time-out will occur after the end of the time-out of SS1, preferably approximately 5 seconds.

Also, although I have described the function of my control in FIG. 2 as applicable to a residential shower operation, I am aware that the control unit I have designed could also be used for many other operations of control. For instance, the system may be adapted to respond to coded signals to open doors, turn on and off lights and appliances, with each being adaptable to respond to its own audible code system. In the drawings I have also shown, and identified above, systems which respond to different signals.

I defined above what I meant by MODE 1, MODE 2, and DUAL MODE, capabilities for my systems. Now, in FIG. 3, I am diagramming a preferred embodiment for my DUAL MODE system.

In this modified circuit arrangement, I am providing a manner for my system to operate in either MODE I or MODE II as desired by the user simply by switching mode SW to either position "1" to operate in MODE I, or to position "2" to operate in MODE II.

In MODE II operation, the user turns on the system in the same manner as I have described for MODE I operation with sensor SW sensing the water pressure, then closing to cause water to flow. But then, to turn the water off, the user makes, or causes to be made, one quick, rapid, audible signal. Flip-flop 2, FF2, and flip-flop 3, FF3, form a counting circuit, which counts the noise occurrences. Capacitor 12 and resistor 21 form a differentiating network to create a positive pulse for gate G1. Then, inverter INV1 provides means for a reset for the counters FF2 and FF3. Gate G3 is an AND gate which prevents timer SS1 from retriggering until after its time-out.

Figure 4:
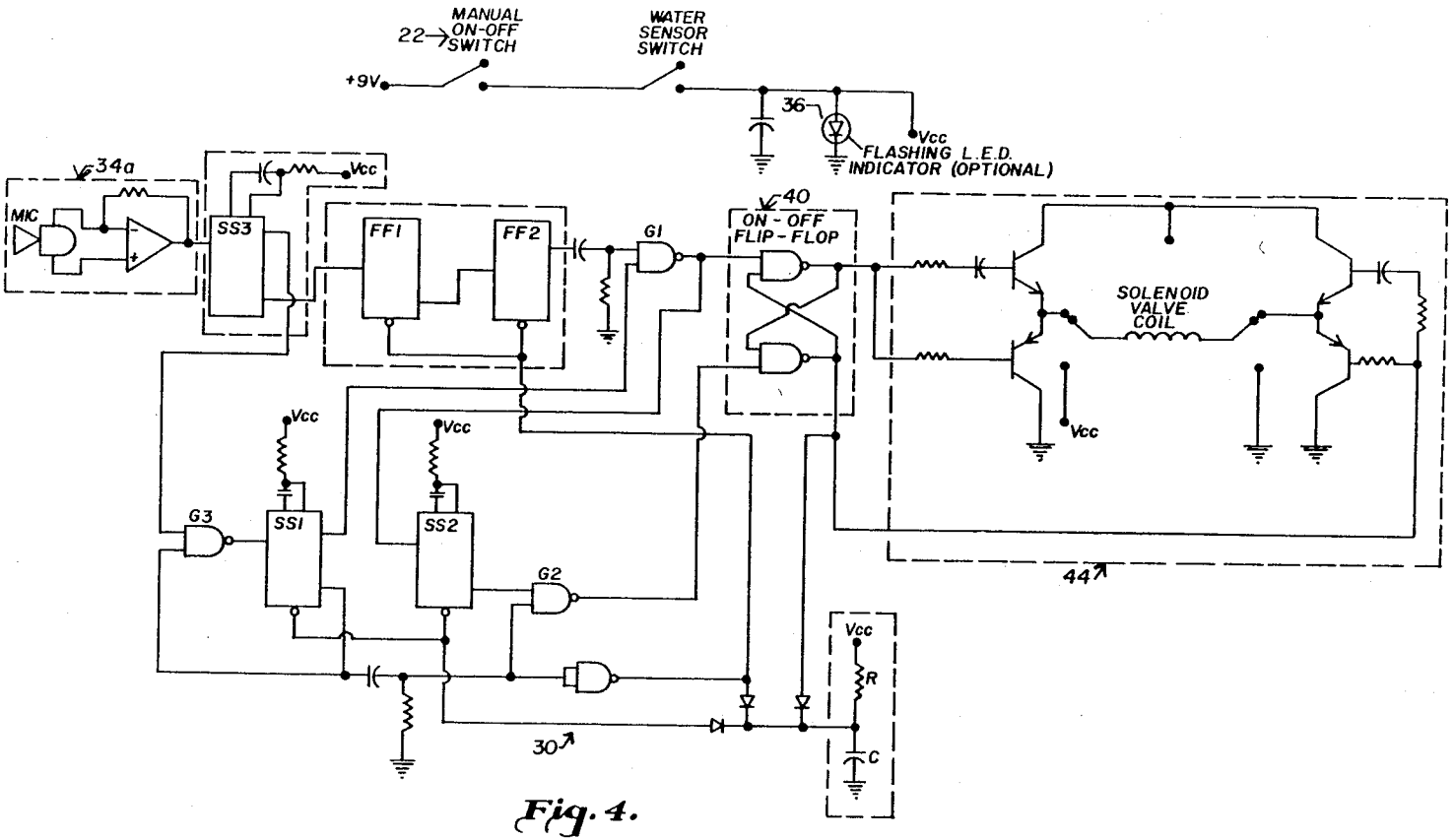
FIG. 4 is a schematic diagram of another alternate embodiment of my invention exemplifying another modified circuit arrangement.

In FIG. 4 I describe a modified form of circuit which serves as a MODE II operation only. In this version I also show other circuit modifications. For instance, microphone and audio amplification stage 34*a*, generally, is shown as a simplified circuit, which is readily understood.

The input audio signal is amplified to produce a full-swing signal (Vcc to ground) which is sent to the SS3 retriggerable timer. The timer is timed only long enough to remain high during the existence of the audio signal and for perhaps 20 ms afterward. Each cycle of the audio signal reinitiates the time-out of this SS3 timer, keeping it constantly set.

Figure 3:
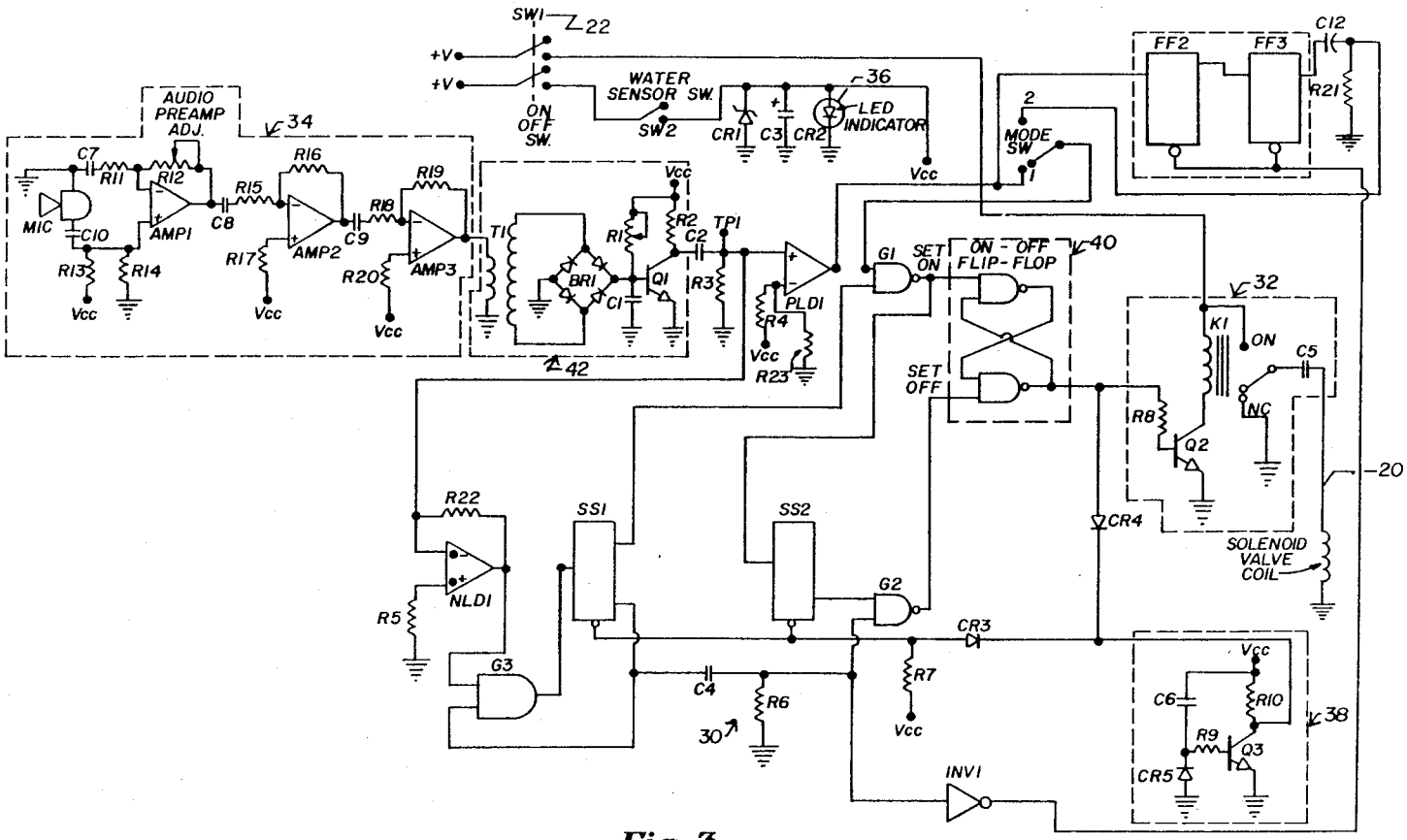
FIG. 3 is a schematic diagram of an alternate embodiment of my invention exemplifying a modified circuit arrangement.

As in the systems described in FIGS. 2 and 3, the user turns on the system, and water begins to flow as the water pressure is sensed by the water sensor switch. When the user wishes to stop the water flow, he may make one audible sound, either one syllable or one rap on the wall. In this figure I have shown an inexpensive power-up initializer circuit 46.

When the user wishes the water to flow again, he simply utters two syllables quickly or makes two quick raps on the wall. These two signals should take place within the time limit of the time-out period of timer SS1, that is, before SS1 times out. The beginning of the first word or sound initiates SS1 time-out period, which is approximately 1.5 seconds. The completion of each of the first and second signals applies a positive charge to FF1, so that the completion of the two signals applies two positive charges to FF1 which sets FF2, which then applies a positive pulse at gate G1 input. Since SS1 has not completed its time-out at this time, the other input to gate G1 is also high, which enables gate G1 and causes the on-off flip-flop 40 to set in the "on" condition which signals solenoid valve control circuit 44 to power the solenoid valve coil and cause the valve to open.

The valve can be shut off when the user speaks one word or makes one quick sound, since the beginning of the sound starts the SS1 time-out, and there is no positive output at FF2, and also, since there is no enabling of gate G1, SS2 would not have started its time-out, and this means that the Q-not out output of SS2 remains high which keeps the top input to gate G2 high. When SS1 times out, a positive signal is sent to the lower input of gate G2, enabling it and causing the on-off flip-flop 40 to reset which brings the valve to the closed state.

SS2 prevents the on-off flip-flop 40 from resetting at the end of SS1 time-out if it had been previously set. This is done by SS2 disenabling gate G2.

Gate G3 is to prevent the retriggering action of SS1 until after its own time-out has taken place.

In this modification I have provided a momentary double pole double throw switch SW3, generally, to allow a manual control feature whenever it might be needed.

Figure 5:
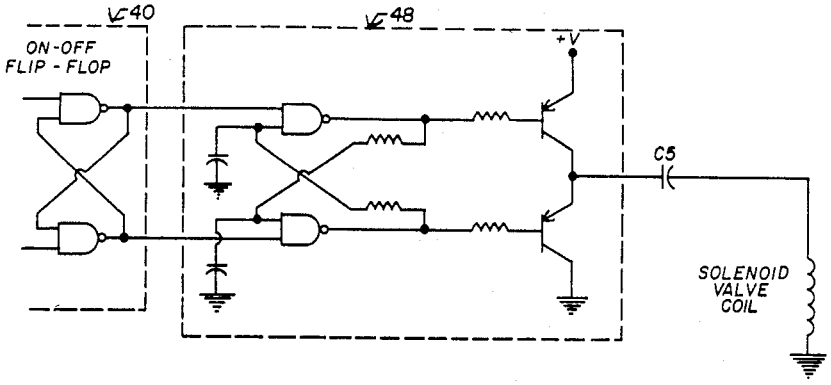
FIG. 5 is a schematic diagram of an alternate circuit arrangement for a control for a solenoid valve coil of my invention.

In FIG. 5 I describe an alternate solenoid valve coil drive circuit 48, generally, outlined by the dotted lines, which can be used to replace K1 relay shown in the solenoid valve drive circuits of FIGS. 2 and 3. The actuation of drive circuit 48 and actuation of the solenoid valve coil should be readily understood by one skilled in the art.

Figure 6:
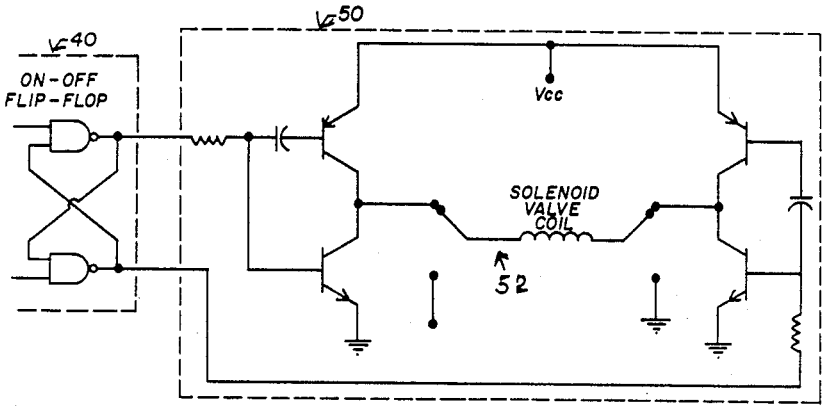
FIG. 6 is a schematic diagram of another alternate circuit arrangement for a control for a solenoid valve coil of my invention.

In FIG. 6 I have shown another alternate form of solenoid valve coil drive circuit 50, generally, which may be used to replace the K1 relay mentioned above. Again, this circuitry and the control of the solenoid valve are readily understood by one skilled in the art. In each case, the circuits of FIGS. 5 and 6 receive the "on-off" signals from the flip-flop 40 and actuate the valve. In the component 50 of FIG. 6, I have provided also a mentary DPDt switch 52 to allow the user to manually force the valve open if he wishes.

Figure 7:
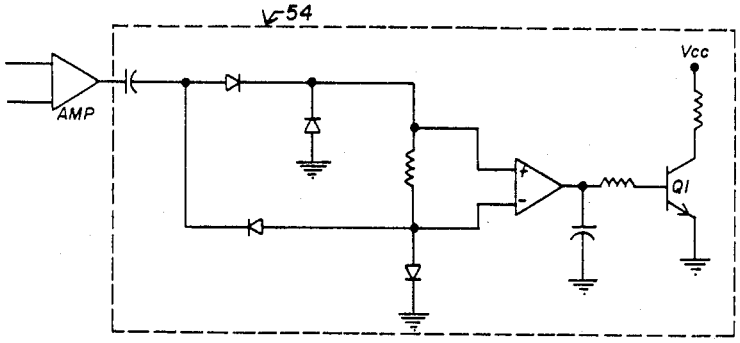
FIG. 7 is a schematic diagram of a circuit arrangement as a substitute for a transformer of my invention.

FIG. 7 describes an alternate noise rectification and smoothing circuit 54, generally, which may be substituted for the circuitry shown in FIG. 2 between AMP 3 and C2 of component 42. This unit serves the same purpose and should also be readily understood by one skilled in the art.

Figure 8:
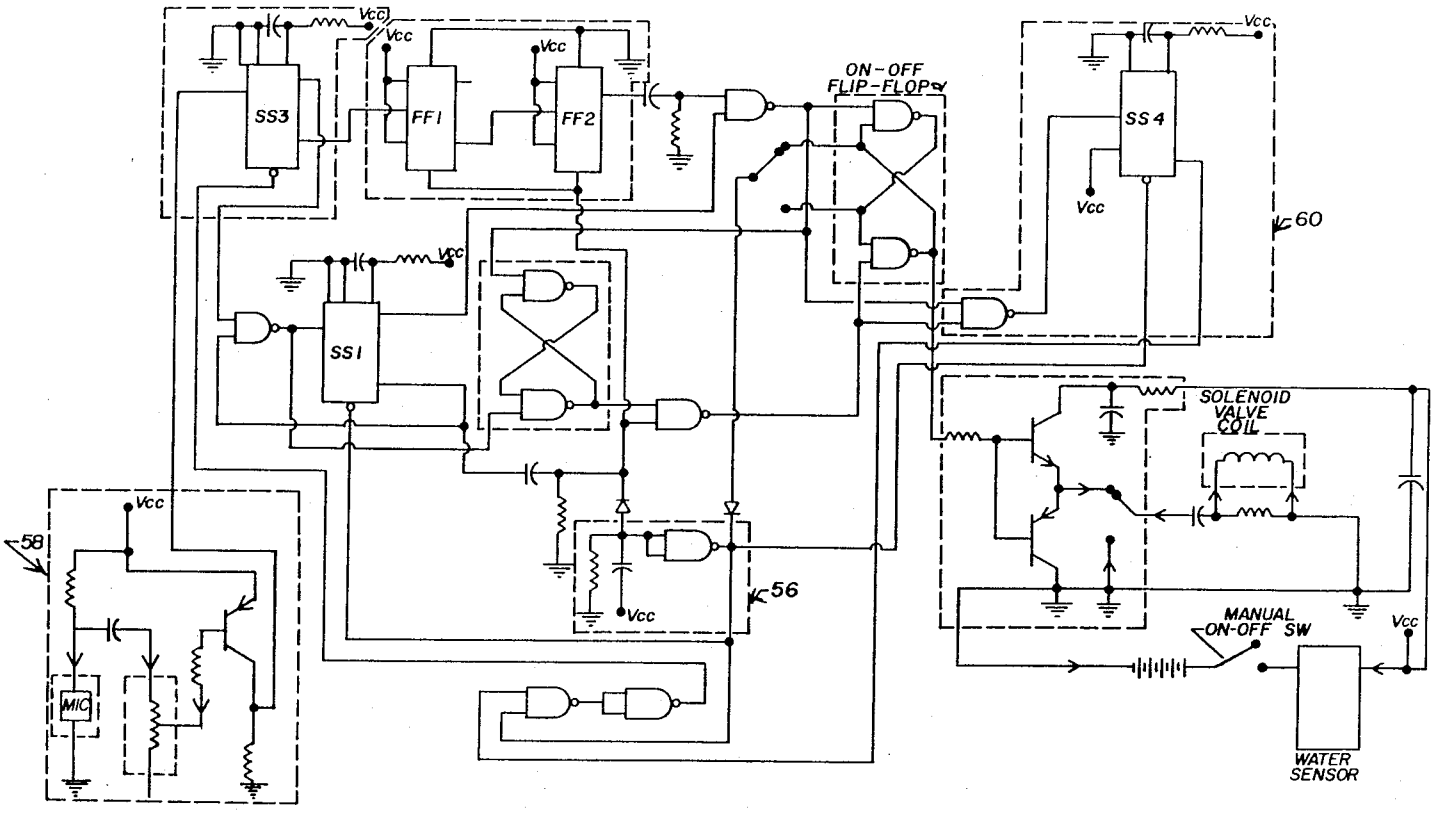
FIG. 8 is a schematic diagram of still another circuit arrangement for my invention.

In FIG. 8 I describe another alternate embodiment of my invention for MODE II operation. In this version I have made several substitute components. The operation of the system of FIG. 8 is the same as the MODE II operation of FIG. 4. I have provided for alternate means for sensing the water pressure. I show a modified power-up initializer circuit 56. Then, to receive the audible signals, I provide another embodiment of a microphone and amplification stage which supplies the signal to the noise rectification and filtering or smoothing circuit, including the SS3 retriggerable timer. In this version I have added a valve state change timer inhibiting circuit 60, generally, which inhibits the effect of the input audio noise during and for a short time after the valve has changed from one state to another, e.g., the noise of the valve itself. As in FIG. 4, I include a two stage noise counter 62, generally, including FF1 and FF2.

Figure 9:
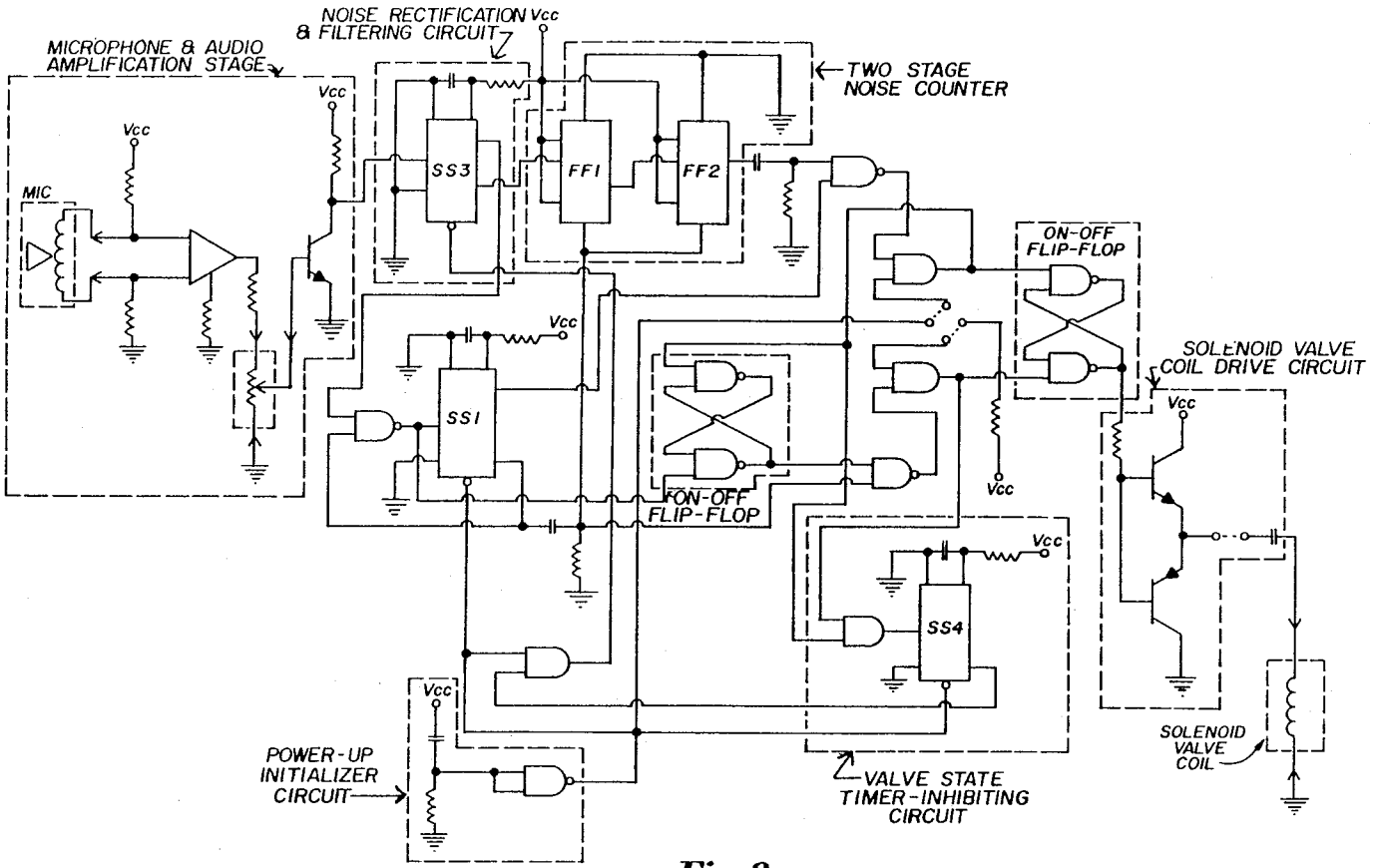
FIG. 9 is a schematic diagram of still another circuit arrangement for my invention.

In FIG. 9 I describe another alternate embodiment for my MODE II operation with several modified circuitry components. Most of the components have been previously described and still serve the same purpose. An added feature is a control on-off flip-flop 64, generally, as a substitute for the SS2 timer. I have also in mind several other features which could be easily incorporated into my system. For example, I believe the manual pre-amp adjustment stage could be replaced by a type of automatic gain control component to adjust the gain level during the initial stage. I can also conceive that my unit could be arranged to respond to various other types of audio signals. For example, as the user wishes, a variety of coded signals which he might change to suit himself.

I can also expect that my system could be supplied with an automatic shut-down feature which will close the water valve after a specific time-out period in event the user neglects to turn the water off.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. In a water supply system having an electrically controllable outlet valve, the improvement comprising:

means for receiving an exteriorly produced signal to direct a condition of the system, means, responsive to said means for receiving an exteriorly produced signal, for generating a signal indicative of a change of condition of the system, and means, responsive to said means for generating a signal, for discriminating between an on condition signal and an off condition signal and appropriately controlling said valve, comprising:

a first timing circuit and a second timing circuit interconnected with switching means.

2. A water supply system as described in claim 1 which includes:

means, interconnected with means for receiving an exteriorly produced signal and with means for generating a signal indicative of a change of condition of the system, for setting an electrical component of the system.

3. A water supply system as described in claim 2 wherein the means for receiving an exteriorly produced signal includes:

means for transducing the exteriorly produced signal to an initial signal.

4. A water supply system as described in claim 3, wherein the means for generating a signal indicative of a change of condition of the system includes:

means for amplifying the initial signal, and means for smoothing the initial signal.

5. A water supply apparatus, comprising:

an electrically controllable outlet valve in a water line, a water sensing component to connect a source of power to the apparatus when water pressure becomes sensed, an initializer circuit connected with the water sensing component to set an electrical component of the apparatus at an initial state, signal receiving means for receiving an externally generated signal and transducing said signal to an electrical signal to said electrical component, and a discriminating circuit connected to said valve, to said initializer circuit, and to said signal receiving means whereby a first signal is acknowledged to place the valve in a first condition, and a second signal is discriminated to place the valve in a second condition.

6. A water supply apparatus as described in claim 5 wherein the discriminating circuit includes:

a first timing circuit, and a second timing circuit interconnected with switching means.

7. A water supply apparatus as described in claim 6 wherein the signal receiving means includes:

means for amplifying the electrical signal, and means for smoothing the electrical signal.

8. A water supply apparatus as described in claim 7 wherein the signal receiving means includes:

an audio reception component.

9. A water supply apparatus as described in claim 8 wherein the signal receiving means includes:

means for pre-amplifying adjustment.

* * * * *